United States Patent [19]

Morrison et al.

[11] 3,986,632

[45] Oct. 19, 1976

[54] CONVENIENCE CLOSURE WITH SAFE EDGES

[75] Inventors: John Morrison; William F. Elser, both of Toledo, Ohio

[73] Assignee: Owens-Illinois, Inc., Toledo, Ohio

[22] Filed: Sept. 12, 1975

[21] Appl. No.: 612,898

Related U.S. Application Data

[62] Division of Ser. No. 498,710, Aug. 19, 1974, Pat. No. 3,939,787.

[52] U.S. Cl. ..... 220/273; 220/90.6

[51] Int. Cl.[2] ..... B65D 41/32

[58] Field of Search ..... 220/270–273, 220/90.6; 113/121 C

[56] References Cited

UNITED STATES PATENTS

| | | | |
|---|---|---|---|
| 3,630,408 | 12/1971 | Elser | 220/273 |
| 3,696,961 | 10/1972 | Holk, Jr. | 220/90.6 X |

*Primary Examiner*—George T. Hall

*Attorney, Agent, or Firm*—A. J. Steger; E. J. Holler

[57] ABSTRACT

A convenience closure having a removable central panel. A convenience closure is attached to a can end to seal the can. The closure includes a removable central panel; a panel fold with an endless severing line formed in its upper surface; a chuck wall fold which has a nose portion that extends radially inwardly farther than the severing line and overlies the severing line; and a pull tab, attached to the central panel, which has a nose portion that extends to the severing line. The panel fold includes a nose portion that extends to a position adjacent to and under the severing line. To remove the central panel, the pull tab nose is depressed to break the severing line. Then, the pull tab is moved upwardly to complete the breaking of the severing line and remove the central panel. Breaking the severing line forms two sharp raw edges; one lies under the nose of the chuck wall fold and is thus protected. The other raw edge is formed adjacent the nose of the panel wall fold. This edge is burnished and rolled into the panel wall fold nose by interference with the nose of the chuck wall fold during removal of the central panel.

2 Claims, 9 Drawing Figures

CONVENIENCE CLOSURE WITH SAFE EDGES

This is a division of application Ser. No. 498,710, filed Aug. 19,1974, now U.S. Pat. No. 3,939,787.

BACKGROUND OF THE INVENTION

This invention generally relates to convenience closures. More specifically, this invention relates to such closures having removable central panel portions. Most particularly, this invention relates to such closures wherein the raw edge formed in the portion of the closure which is not removed is protected by the nose of a fold in the closure and the raw edge formed on the removable central panel is burnished and rolled during removal to thus render it harmless.

The use of convenience closures with removable central panels is quite common. A problem with such closures is the sharp edges formed when the central panel is removed. The central panel itself presents a sharp raw edge and a second edge is also left on the portion of the closure which remains on the container. Examples of prior art attempts to solve this raw edge problem may be seen in U.S. Pat. Nos. 3,696,961; 3,705,563; and 3,819,083. However, none of these closures have been completely successful in rendering both raw edges harmless. We have found that the edge left on the portion of the closure remaining on the container may be protected by an extending nose portion of a fold. Then, the edge formed on the removable central panel can be burnished and rolled to thus render it harmless by forcing it into interference with the nose portion remaining on the container as the central panel is removed.

SUMMARY OF THE INVENTION

Our invention is a convenience closure for a container. The closure includes a removable central panel; a panel fold with an endless severing line formed in the upper surface thereof, the panel fold including a nose portion which extends to a position adjacent and under the severing line; a chuck wall fold with a nose portion which extends radially inwardly farther than the severing line and overlies the severing line; and a pull tab attached to the central panel; the pull tab including a nose portion which extends to the severing line.

DETAILED DESCRIPTION OF THE DRAWINGS

Figure 1:
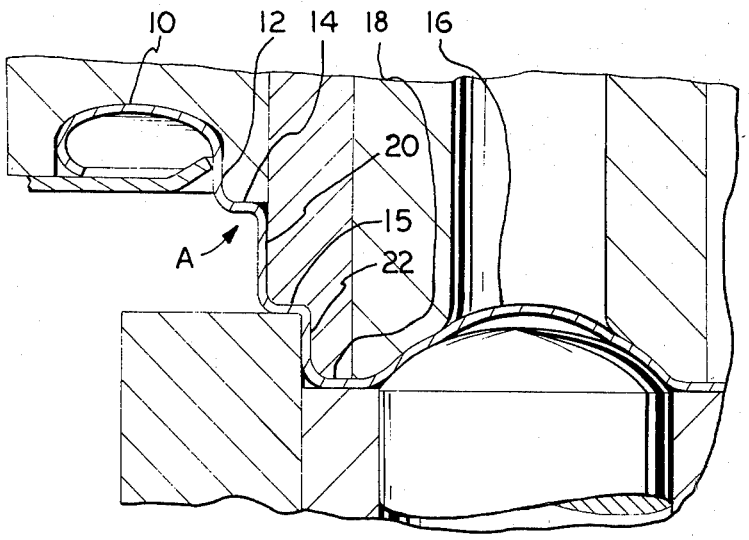
FIGS. 1–6 are fragmentary elevational sectional views showing successive steps in a method of forming the convenience closure of the present invention.

FIGS. 1 through 6 illustrate the progressive stages in the formation of the convenience closure of the present invention from a blank. These steps are carried out in a conventional, progressive die-forming machine, and the application and use of such a machine should be quite clear to those skilled in the art of forming such closures. Therefore, the details of the dies themselves and the transfer mechanisms involved are omitted, since the major focus of interest is that of the closure itself rather than the precise configurations of the dies used. The convenience closure of the present invention is preferably made from a relatively thin aluminum sheet material. This material may be in the range of from 0.008 to 0.015 inch in thickness. In the first stage of the closure formation illustrated in FIG. 1, a blank A has a seaming panel 10 formed from the peripheral edges of the blank. The seaming panel 10 is later used to double seam this convenience closure onto the end of a conventional can. Attached to the seaming panel 10 is a perimetrical upstanding wall portion of the closure, which is known in the art as a chuck wall 12. In the initial forming steps shown in FIG. 1, two ledges 14 and 15 are formed. Also formed in this initial step is a bubble portion 16, which will eventually be formed into a rivet for attaching a pull tab to this closure. The bubble 16 is formed from a portion of a central panel 18 of the blank A. An upstanding wall portion 20 connects the ledge 14 to the ledge 15. A similar wall portion 22 is connected to the lower edge 15 and to the central panel 18.

Figure 2:
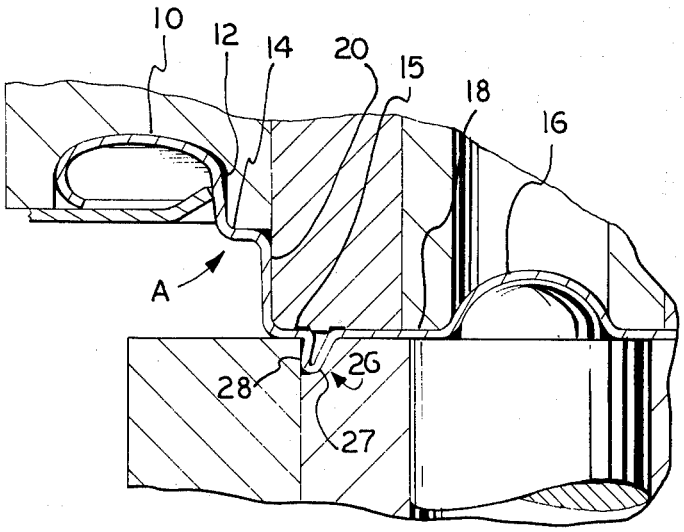

In the second stage of the forming operation shown in FIG. 2, the outer margin of the central panel 18 has been bent upon itself to form a loose loop 26, and the bubble 16 has been further shaped. Note that the loop 26, speaking with respect to the vertical center line of the entire closure blank A, has an inner portion 27 and an outer portion 28.

Figure 3:
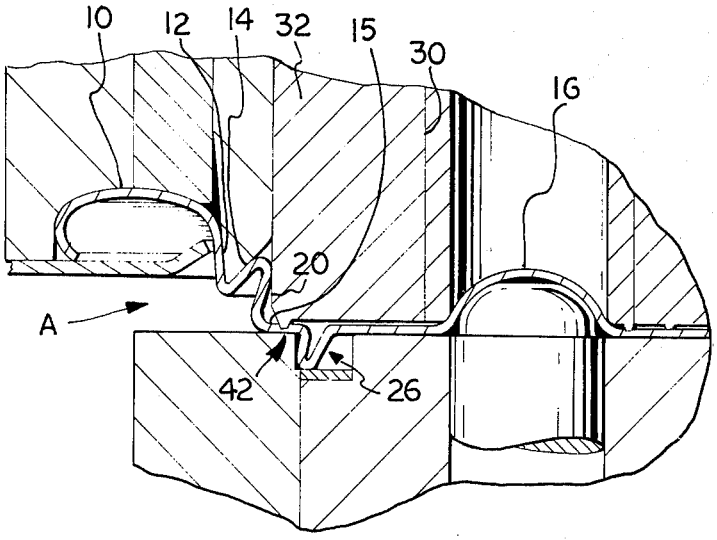

In FIG. 3, a scoring die 30 scores the blank A along an endless circular line 42 on the lower ledge 15. Also note that in FIG. 3, simultaneously with the scoring of the ledge 15, the upper ledge 14 and the upstanding wall portion 20 are bent to form a relatively loose loop 32.

Figure 4:
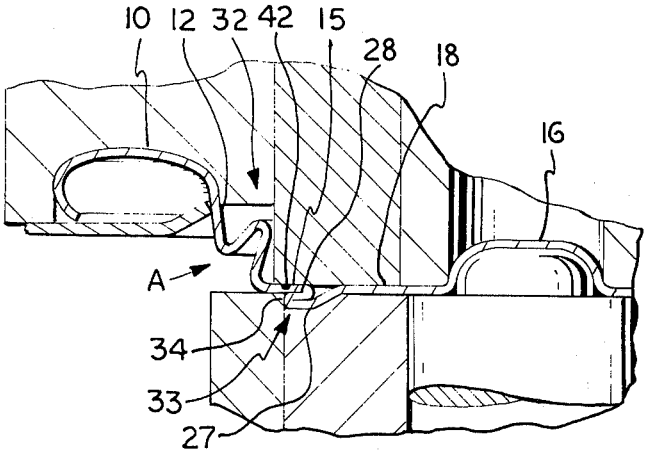

In FIG. 4, the loop 26 has been bent upwardly so that the outer portion 28 of the loop 26 is lying in abutting relationship with the lower ledge 15. Similarly, the inner portion 27 of the loop 26 has been bent upwardly so that it is in abutting relationship with the outer portion 28 of the loop 26. Thus, at this point, there are three layers of material defining a panel fold 33 which has a projecting outer nose portion 34.

Figure 5:
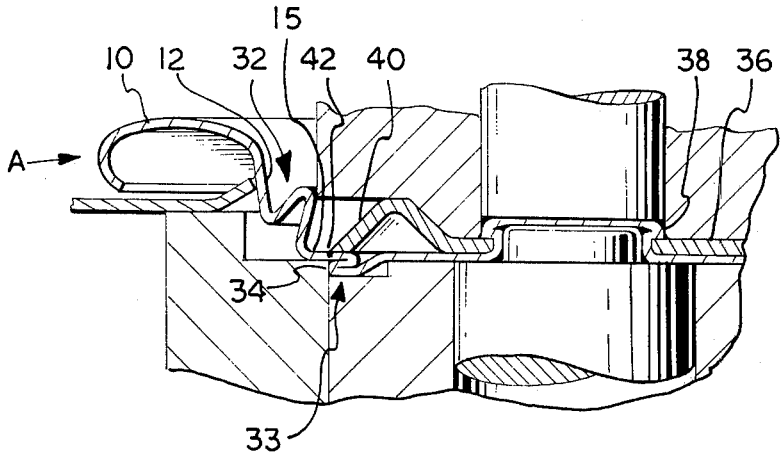

In FIG. 5, a pull tab 36 has been inserted over the completely formed bubble 16; and the bubble 16 has been compressed to form a rivet 38, which holds the pull tab 36 in place. The pull tab 36 includes a nose portion 40, which is preferably positioned such that its outermost edge lies approximately over the center line of the score line or severing line 42, which was placed in the lower ledge 15 by the scoring die 30.

Figure 6:
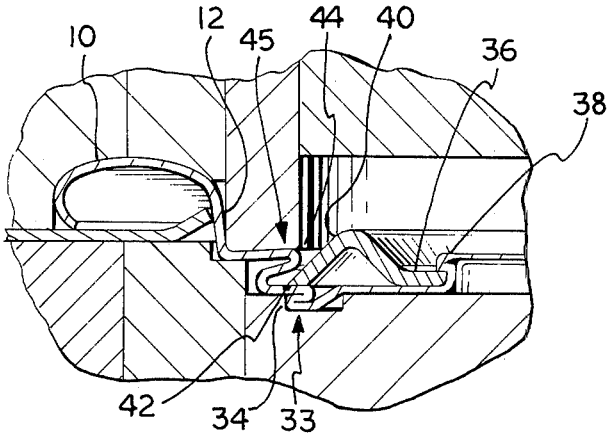

FIG. 6 shows the final operation to complete the convenience closure of the present invention. In this step, the loose loop 32 is folded inwardly, overlying completely the score line 42. It is to be noted that the loose loop 32 remains in a generally loose configuration, and the layers are not compressed together, as was the case with the loop 26. An end, or nose portion, 44 is positioned so that it is inward of the score line 42 and very close to the nose portion 40 of the pull tab 36. The loop 32 so folded constitutes a chuck wall fold 45.

Figure 7:
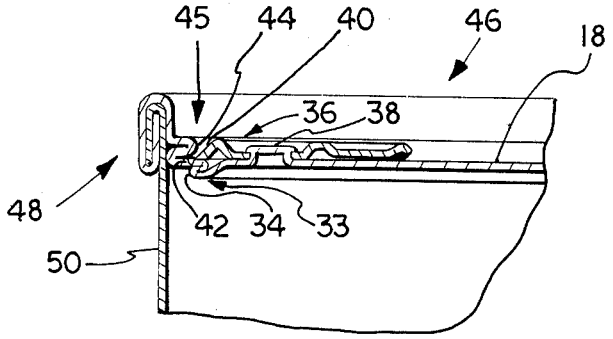
FIG. 7 is a fragmentary elevational sectional view of the convenience closure of the present invention in place on a container.
Figure 8:
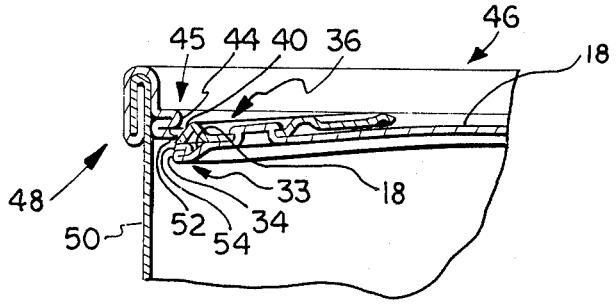
FIG. 8 is a view similar to FIG. 7 showing depression of the pull tab to initially break the severing line.
Figure 9:
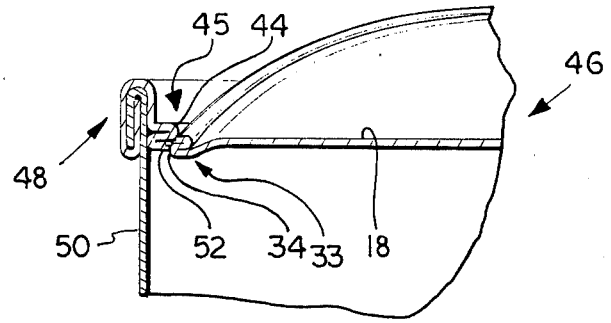
FIG. 9 is a view similar to FIGS. 7 and 8 showing the interference of the raw edge of the central panel with the nose of the chuck wall fold during removal of the central panel.

FIGS. 7, 8 and 9 illustrate the removal of the central panel 18 of the convenience closure of the present invention from the end of a container to which it is fixed. In FIG. 7, the convenience closure of the present invention, now designated as 46, is seen as being double seamed, as generally illustrated at 48, to one end of a container 50, such as a can. In FIG. 7, the configuration of the closure 46 is essentially the same as that shown in FIG. 6. The nose portion 40 of the pull tab 36 is partially overlying the score line 42, and the score line 42 is under the nose portion 44 of the chuck wall fold 45. To state this another way, the diameter of the score line 42 is greater than the diameter defined by the nose portion 44. In FIG. 8, the nose portion 40 of the pull tab 36 has been depressed downwardly to break the score line 42. This is conventional practice in the art of convenience closure ends. The breaking of the score line 42 then allows the entire central panel portion 18 to be removed from the end of the container 50, thus allowing access to the interior of the container 50. Note that in breaking the score line 42, two raw edges, designated as 52 and 54, are formed. The raw edge 52 is protected from contact with a person's hands by the nose portion 44 of the chuck wall fold 45. By laying under the nose portion 44, it is impossible for a person to reach the raw edge 52 and thus be cut by it.

In theory, and according to the teaching of some of the prior art, the raw edge 54 should be recessed back far enough to be protected by the nose portion 34 of the panel fold 33. However, it is easy to see that the raw edge 54 cannot be completely protected by the nose portion 34, since the nose portion 34 is essentially on the same line as the score line 42. Thus, the raw edge 54 projects slightly beyond the end of the nose portion 34. FIG. 9 illustrates how the raw edge 54 is successfully contained by the closure 46 of the present invention. As the pull tab 36 is pulled upwardly to remove the central panel 18, the raw edge 54 is unable to pass by the nose portion 44 of the chuck wall fold 45. This is because, as will be recalled from FIG. 6, the score line 42 was placed completely under the nose portion 44. Thus, if the raw edge 54 is to be removed from the container 50, it is necessary that there be an interference between the nose portion 44 and the raw edge 54. This occurs, as shown in FIG. 9, and causes a burnishing action on the raw edge 54. In addition to the burnishing action, which tends to smooth the raw edge 54, the raw edge 54 is also rolled slightly downwardly into the nose portion 34 of the panel fold 33. This action provides substantial destruction of the raw edge 54 and thus allows the central panel 18 to be completely safe with no raw edges exposed. It should be emphasized that this action essentially causes the raw edge 54 of the central panel portion 18 to disappear. It is not a question of attempting to protect the raw edge 54, as the raw edge 52 was protected, from contact with hands; rather, the interference with the nose portion 44 causes the raw edge 54 to be substantially eliminated. This presents a central panel section which, when completely removed from the container 50 is safe, in that it presents no raw or sharp edges which could cause injury.

We claim:

1. A method for eliminating a raw-severed edge in a convenience closure for a container, said convenience closure having a central panel, a panel fold with an endless severing line formed on the upper surface thereof, said panel fold including a nose portion extending to a position adjacent and under said severing line, a chuck wall fold, having a nose portion extending radially inwardly farther than said severing line, said chuck wall fold overlying said severing line, and a pull tab attached to said central panel, said pull tab having a nose portion extending to said severing line, the method comprising the steps of:

depressing said nose portion of said pull tab downwardly to thereby break a portion of said severing line;

pulling said pull tab upwardly to break the remainder of said severing line and thereby remove said central panel from said convenience closure; and simultaneously therewith burnishing a raw severed edge formed adjacent said panel fold by contact with said nose portion of said chuck wall fold and folding said burnished edge into said nose portion of said panel wall fold as said central panel is removed from said convenience closure.

2. A convenience closure for a container which comprises, in combination:

a central panel;

an upstanding chuck wall;

a relatively loose chuck wall fold, formed from a portion of said chuck wall, having a nose portion extending radially inwardly;

a relatively tight panel fold, formed from a portion of said central panel, having a radially outwardly extending nose portion;

a common ledge connecting said chuck wall fold and said panel fold, said common ledge having formed therein an endless severing line of a diameter greater than the diameter of said nose portion of said chuck wall fold but less than the diameter of said nose portion of said panel wall fold, whereby breaking said severing line will leave a first raw edge under said chuck wall fold and a second raw edge projecting beyond said panel fold nose portion; and a pull tab attached to said central panel for removing said central panel by breaking said severing line, said pull tab having a portion extending under said chuck wall fold into proximity with said severing line.

* * * * *